US006519307B1

(12) United States Patent
Singh et al.

(10) Patent No.: US 6,519,307 B1
(45) Date of Patent: Feb. 11, 2003

(54) VENTILATED OVERPACK APPARATUS AND METHOD FOR STORING SPENT NUCLEAR FUEL

(75) Inventors: Krishna P. Singh, Palm Harbor, FL (US); Everett L. Redmond, II, Marlton, NJ (US); John C. Wagner, Oak Ridge, TN (US); Stephen J. Agace, Tabernacle, NJ (US)

(73) Assignee: Holtec International, Marlton, NJ (US)

( * ) Notice: Subject to any disclaimer, the term of this patent is extended or adjusted under 35 U.S.C. 154(b) by 0 days.

(21) Appl. No.: 09/580,407

(22) Filed: May 30, 2000

(51) Int. Cl.[7] ..... G21F 5/00
(52) U.S. Cl. ..... 376/272; 250/506.1
(58) Field of Search ..... 376/272; 250/506.1, 250/502.1

(56) References Cited

U.S. PATENT DOCUMENTS 4,527,066 A * 7/1985 Dyck et al. ..... 376/272
4,894,550 A * 1/1990 Baatz et al. ..... 376/272
5,852,643 A * 12/1998 Copson ..... 376/272

FOREIGN PATENT DOCUMENTS

DE 2711405 * 9/1978
DE 3317634 * 11/1984

* cited by examiner

*Primary Examiner*—J. Woodrow Eldred
(74) *Attorney, Agent, or Firm*—Cozen O'Connor; Michael B. Fein

(57) ABSTRACT

A ventilated overpack apparatus for containing a spent nuclear fuel canister has photon radiation scattering attenuators in the air ducts, preferably at or near the external openings. The apparatus preferably has straight ambient air inlet ducts and straight hot air outlet ducts which allow for improved rates of air flow and, because of the radiation scattering attenuators, far more efficient trapping of photons and reduced dose rates versus prior curvilinear or serpentine duct designs. The method of storing spent nuclear fuel comprises inserting a canister in the ventilated overpack apparatus which has the photon radiation scattering attenuators in the ducts. Preferably the top ducts are formed by three-sided channels in the sidewalls of the overpack and a fourth side formed by the flat bottom of the top lid, and the bottom ducts are also formed by three sided channels with the fourth side being formed in part by the bottom lid and in part by a concrete pad on which the overpack rests.

16 Claims, 6 Drawing Sheets

UNDERSIDE VIEW OF ITEM 12

UNDERSIDE VIEW OF ITEM 12

VENTILATED OVERPACK APPARATUS AND METHOD FOR STORING SPENT NUCLEAR FUEL

BACKGROUND OF THE INVENTION

This invention relates to the storage of spent nuclear fuel.

Spent nuclear fuel (SNF) emits heat and radiation consisting of high-energy gamma rays or photons, and fast neutrons, which must be contained for many decades in containment apparatus. The containment apparatus usually comprises a canister and an overpack. The overpack can be a transportable overpack or an overpack designed for stationary storage. The canister can be one designed for storage only, or can be designed for transporting, short-term storage, or long term storage, such designs being referred to in the art as multi-purpose canisters (MPC). Canisters loaded with SNF must be transported in a suitable transport overpack and stored in suitable storage overpacks, or a suitable permanent overpack. Canisters are generally designed to hold the SNF in a specific arrangement and to fit within each overpack. Each overpack has a central cavity designed to accommodate a canister, and is designed for shielding the radiation emanating from the canister on a permanent basis. The overpack employs concrete, steel, and other effective materials to shield the radiation emitting from the canister containing the SNF.

The overpack must be ventilated to allow the heat from the SNF within the canister to be removed to the atmosphere. The ventilation system generally comprises air entrance ducts at the bottom of the overpack and hot air exhaust ducts at the top, and a vertical space surrounding the canister within the central cavity of the overpack through which the cooling air flows upward as it is warmed by the canister. The rate of air flow into the lower ducts, up along the space between the overpack and the canister, and out the upper ducts is a function of the flow resistance in the air travel path and the temperature of the canister external surface.

The ventilation ducts must be designed to prevent escape to the surrounding area of significant radiation emitting from the decaying SNF but not to interfere with the flow of air. The state of the duct design art prior to the present invention has been to provide curvilinear or serpentine passageways to insure that radiation does not stream out through the duct openings. However, there are problems with such curvilinear or serpentine design strategies, the first being that they are only partially effective in trapping photons, with typical dose rates on a current design (NAC-MPC) being about 24 milli-rem/hour (mrem/hr). The second problem is that the curvilinear duct designs add to the total resistance to airflow resulting in a corresponding reduced rate of ventilation and corresponding heat removal.

It is an object of the present invention to provide an improved ventilated overpack apparatus and method for storing spent nuclear fuel.

It is a further object of the invention to improve the ventilation of overpacks for SNF canisters while at the same time increasing the rate of trapping photons within the overpack.

SUMMARY OF THE INVENTION

These objects, and others which will become apparent from the following disclosure, are achieved by the present invention which comprises in one aspect a ventilated overpack apparatus for containing a spent nuclear fuel canister having ambient air inlet ducts and hot air outlet ducts, and having radiation scattering attenuators in the inlet and outlet ducts. The radiation scattering attenuators are preferably located at the external openings of each of the ventilation ducts.

In another aspect, the invention comprises a method of storing spent nuclear fuel comprising inserting spent nuclear fuel in a canister and inserting the canister in a ventilated overpack having inlet ducts and outlet ducts which have radiation scattering attenuators.

The radiation scattering attenuators are preferably of metal or other material in a sheet or tube form, and can be in an egg crate or cross-hatch configuration, or can be of other configurations such as, for example, several parallel sheets or circles within circles. The radiation scattering attenuators function to reduce the number of photons escaping from the overpack.

DETAILED DESCRIPTION OF THE INVENTION AND THE PREFERRED EMBODIMENTS

Figure 1:
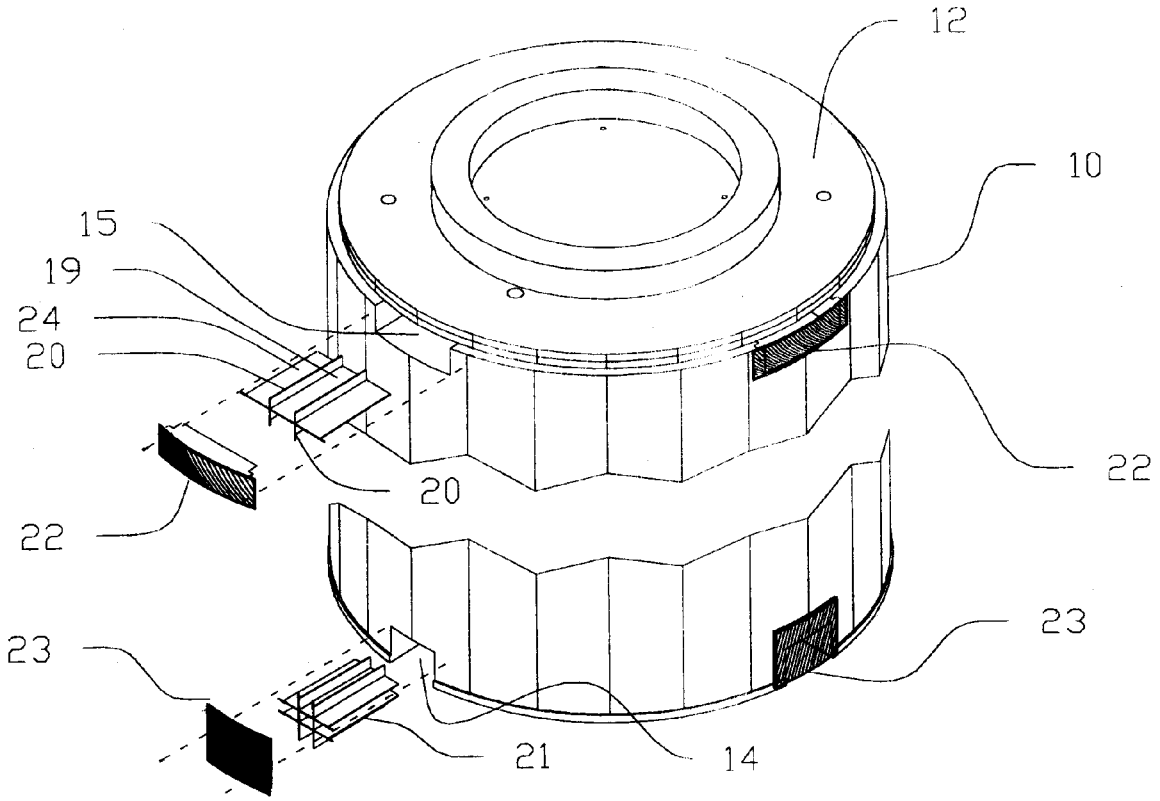
FIG. 1 is a perspective view of the top portion and the bottom portion of an overpack apparatus, with the middle portion not shown, and with an upper attenuator and vent screen and a lower attenuator and vent screen exploded from the respective ducts.
Figure 1:
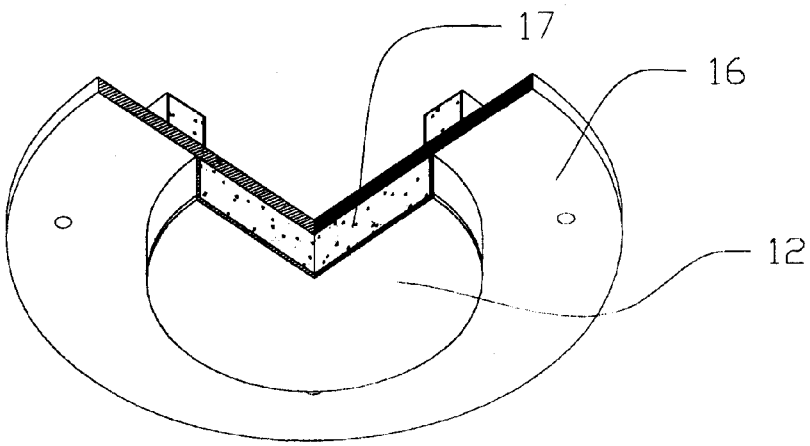

Referring first to FIG. 1, an embodiment of the overpack 10 is illustrated with the middle portion removed. Upper ducts 15 are formed by three sides built into the overpack 10 and one side formed by the bottom of the upper lid 12, resulting in straight ducts with four flat walls. The lower ducts 14 are also constructed by forming three sides in the sidewall of the overpack 10 and providing the fourth side from a combination of the top side of the bottom lid and the concrete pad 32 upon which the overpack rests. The bottom lid may have a smaller diameter than the overpack and in the illustrated embodiment the seventeen outer inches of the bottom of the ventilation ducts is provided by the concrete pad 32.

One of the upper radiation scattering attenuators 24 is shown exploded from an upper duct 15. The attenuators in this embodiment are constructed of one or more horizontal sheet steel members 19 and two or more vertical sheet steel members 20 which are welded together in a gridlike formation. The attenuators are designed to fit in the outermost portion of the upper ducts 15 and lower ducts 14, i.e., at the exit of the upper ducts 15 and at the entrance to the lower ducts 14. After the attenuators 21 and 24 are inserted in ducts 14 and 15, they are covered by vent screens 22 and 23 which function to keep animals, insects, and debris from entering the ventilation ducts. The screening vents 22 and 23 are constructed of steel, plastic, aluminum, or other suitable material and are designed to allow maximum airflow. The vent screens do not function to attenuate radiation.

Figure 2:
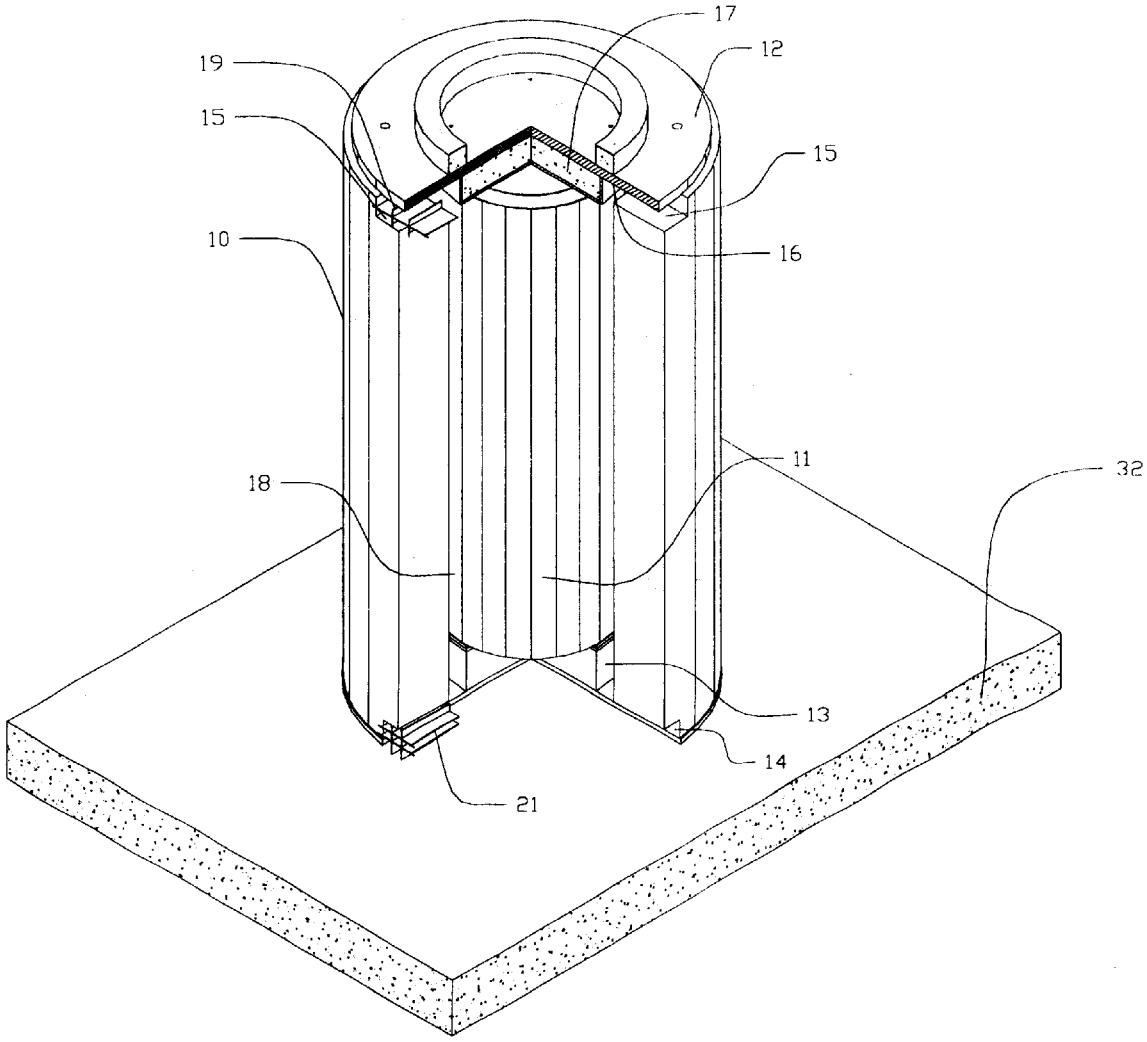
FIG. 2 is a perspective view of an overpack partially in cross section with one quarter section cut away to show a canister in the central cavity of the overpack, with the top lid in place and a canister fully inserted, illustrating the airpath and air flow and showing the radiation scattering attenuators in the left visible duct only, and showing the underside of the lid.

Referring now to FIG. 2, upper ducts 15 are shown in cross section as straight and rectangular, formed by three sides within the sidewall of the overpack 10 and one side formed from the lid 12. The upper lid 12 has concrete 17 in the center portion which functions to shield radiation from escaping through the lid, but does not block the air path between the ventilation ducts 15 and the central chimney 18. The lower steel section 16 of the upper lid forms the top side of the upper ducts 15. The bottom ducts 14 are illustrated in section with the forward portion removed. Lower ducts 14 are formed of three sides built into the sidewall of overpack 10 and are open to the upflow chimney 13 formed between the canister 11 and the inside cavity of the overpack 10. Cool air flows horizontally into the bottom ducts 14 which are straight, and then up the chimney space 13 and 18 and then horizontally straight out the upper ducts 15. The heat emanating from the canister causes the air to be warmed and rise, which pulls cool air into the lower ducts 14 and pushes the hot air out through the upper outlet ducts 15.

Figure 3:
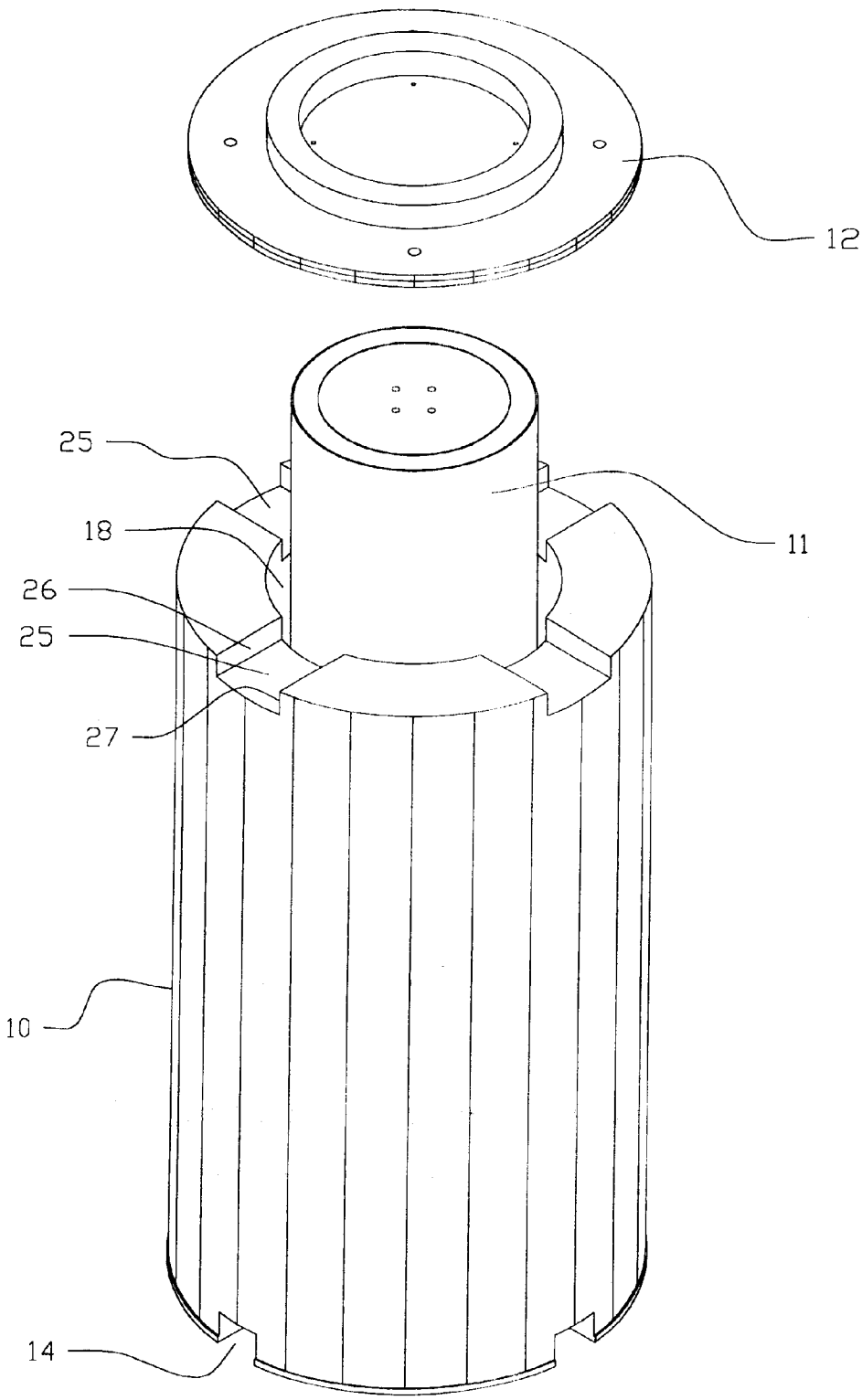
FIG. 3 is a perspective view of an overpack of the invention with the top lid shown floating above and the canister partially inserted, but not showing the radiation scattering attenuators.

Referring now to FIG. 3, overpack 10 is shown with partially inserted spent nuclear fuel canister 11 and upper overpack lid 12 separated from, i.e., not yet secured to, the overpack 10. Two of the bottom ducts 14 are illustrated, and two are not shown. The radiation scattering attenuators are not shown in FIG. 3. The lower side 25, left side 26, and right side 27 form three sides of the upper ducts, and the fourth side of the upper ducts will be formed when the upper lid 12 is secured to the top of the overpack 10. A chimney channel 18 is created by the space between the canister and the walls of the central cavity of the overpack.

Figure 4:
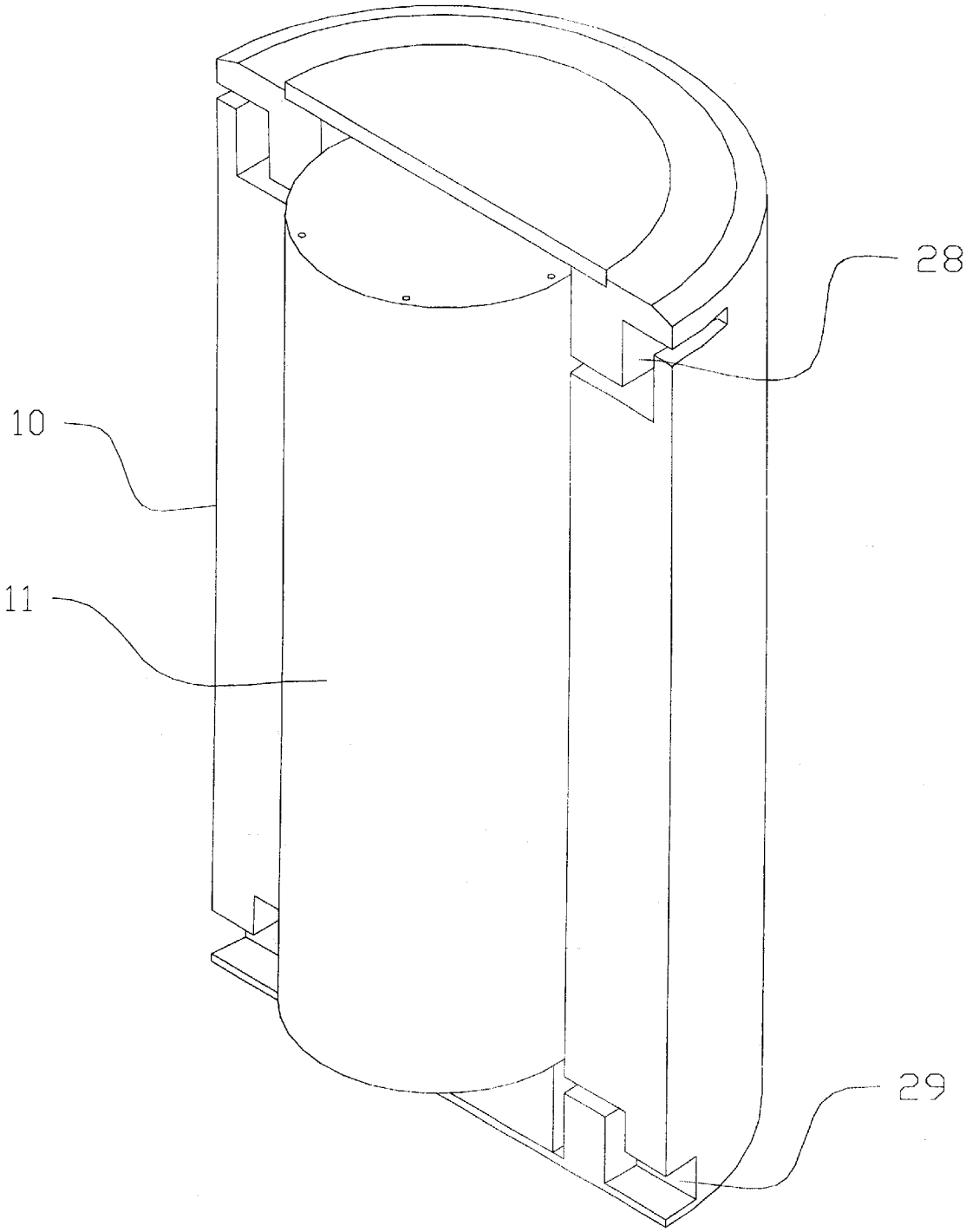
FIG. 4 is a perspective cutaway view of a prior art overpack with a canister inserted, showing curvilinear or serpentine air outlet ducts.

Referring now to FIG. 4, a prior art overpack 10 having canister 11, upper serpentine ducts 28 and lower serpentine ducts 29 is illustrated. The prior art overpacks relied on the serpentine or curvilinear duct passageways for radiation attenuation rather than the attenuators used in the present invention, and suffered from several disadvantages, as mentioned herein, including reduced airflow rates and less effective radiation attenuation when compared to the present invention.

Figure 5:
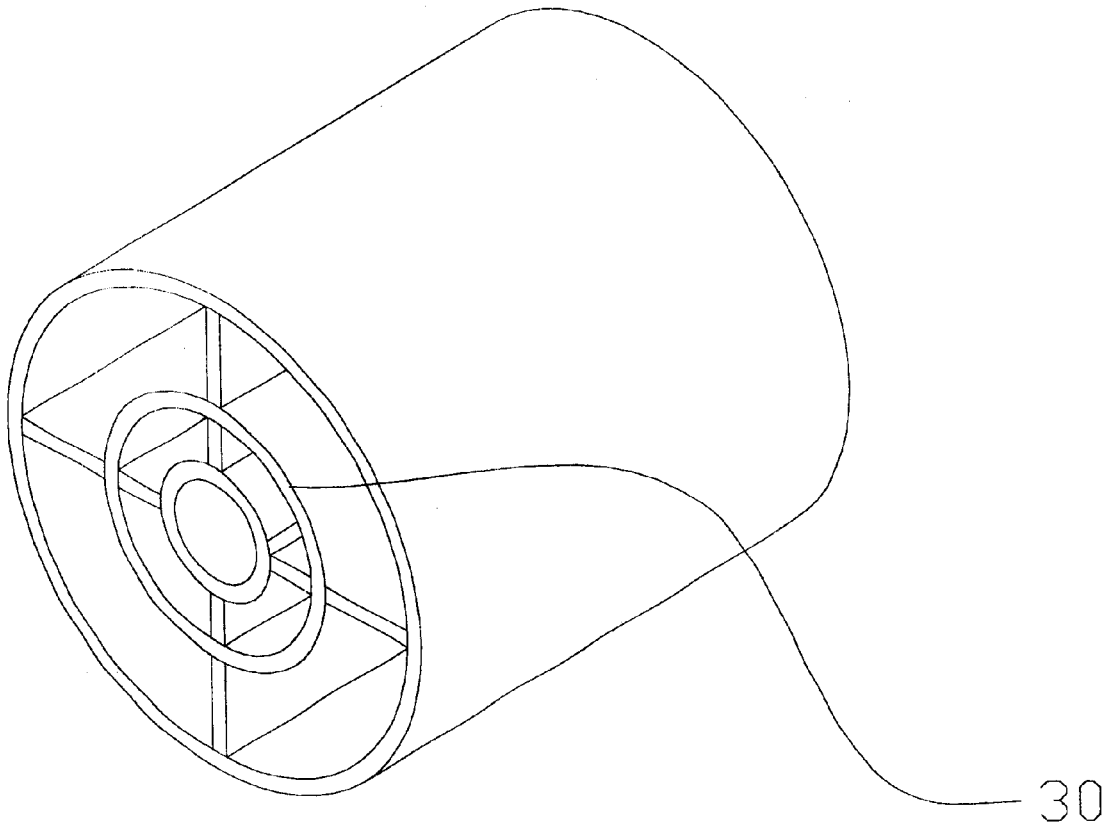
FIG. 5 is a cross-sectional view of a circular attenuator configuration.

Referring to FIG. 5, the radiation scattering attenuators can have different designs, for example attenuators 30 has a circular cross section which would be designed for circular ducts.

Figure 6:
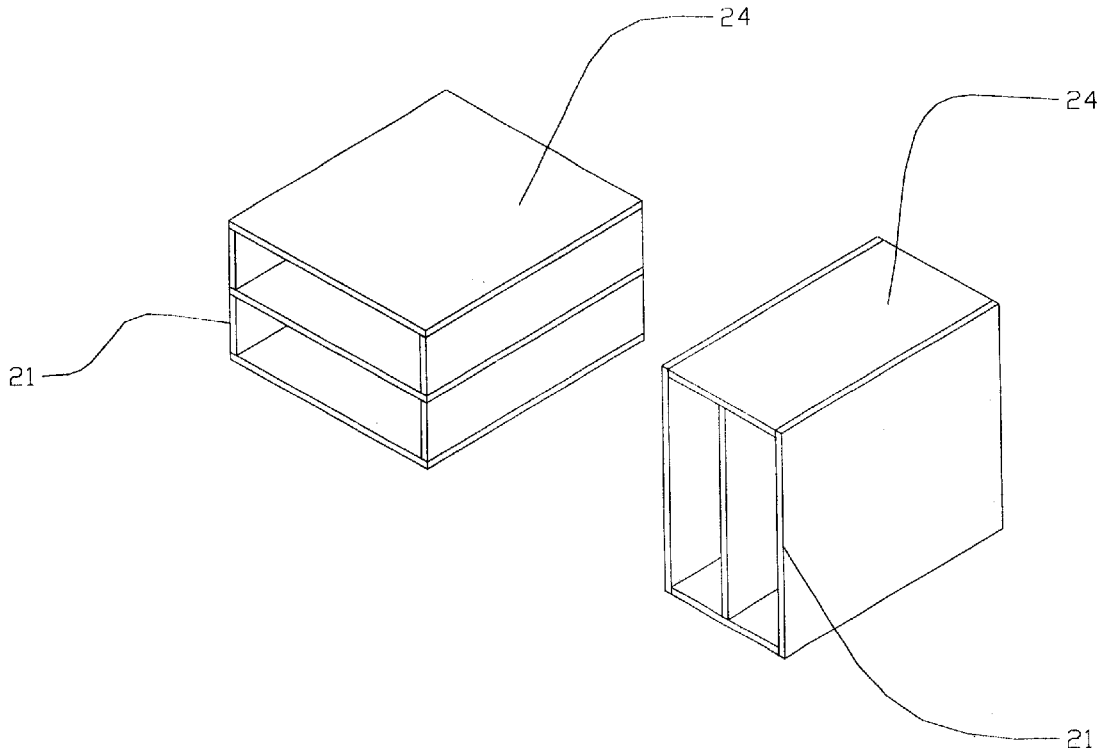
FIG. 6 is a cross-sectional view of two types of parallel-sheet attenuator configurations.

FIG. 6 shows two alternative attenuator designs formed of sheets of parallel sheetwork 21 in one direction welded to sheets 24 which are perpendicular to sheets 21.

The attenuators are preferably grids fashioned from sheetstock in an eggcrate design. The attenuators have the advantage we have discovered of posing minimal restriction to the air flow in and out of the lower and upper ducts, respectively, but effectively attenuating the emission of photons from the ventilation ducts, with calculated dose rates of about 9 mrem/hr in one example, and in most cases less than 10 mrem/hr. The actual dose rate depends on the contents and specific design of the overpack, canister, and attenuator design. In the preferred embodiment, the attenuators have been calculated to reduce the emissions by a factor of four, when compared to the same design with the same contents but without the attenuators.

In operation, the spent nuclear fuel can be stored in an underwater pool and then loaded in a canister which has been placed in the pool. After the canister is loaded, a canister lid is secured while the canister is in the pool, and then the canister is placed in a transportation overpack. The transportation overpack is used to contain the emissions from the canister when it is removed from the pool. The transportation overpack is typically moved to a position where the canister can be lowered into the permanent storage ventilated overpack apparatus of the invention. According to the method of the invention, the canister is lowered into the ventilated overpack which has straight inlet ducts with radiation scattering attenuators at the bottom and straight outlet ducts at the top. The central cavity of the overpack is larger than the canister outer diameter so that there is a vertical chimney space between the canister and the cavity. The upper radiation attenuators are installed at the outer section of the upper ducts and the canister is then sealed in the ventilated overpack by placing the overpack lid in place and mechanically securing it. When the lid is in place, the fourth side of the upper ducts are formed and the upper ducts are completed.

Air flows straight through the lower straight ducts, into the chimney, and out the upper ducts with less resistance than with the prior art serpentine path ducts. Furthermore, when the gridwork duct photon radiation scattering attenuators are in place, the dose rate is reduced by a factor of about 4, as calculated using the state of the art Monte Carlo radiation transport code, MCNP-4A, developed at Los Alamos National Laboratory. Shielding calculations performed with a three-dimensional correct representation of the preferred overpack embodiment and the dose rate was calculated over the opening of the duct. The dose rate was calculated in this location with and without the duct photon radiation scattering attenuators to determine their effectiveness. The calculated dose rate with the attenuator in place was 9 mrem/hr., compared to 39 mrem/hr when the attenuator is removed.

While the invention and the preferred embodiments have been described in detail, various other embodiments, alternatives, modifications, and improvements should become apparent to those skilled in the art without departing from the spirit and scope of the invention as set forth in the following claims.

What is claimed is:

1. A ventilated overpack apparatus for containing a spent nuclear fuel canister having ambient air inlet ducts and hot air outlet ducts, and having radiation scattering attunators in the inlet and outlet ducts, said attenuators fabricated from at least one sheetwork member in a first direction and at least one sheetwork member in a second direction substantially parallel to the first.

2. Apparatus of claim 1 wherein the radiation scattering attenuators in each duct are constructed of sheet stock and the sheetstock is arranged in a direction parallel to the axis of the duct so as to permit straight air flow through the duct.

3. Apparatus of claim 1 wherein each duct has a cross-section which is rectangular, obrund, elliptical, circular, or bi-axially symmetric planform.

4. Apparatus of claim 1 wherein each hot air outlet duct has one side which is formed by a flat area on an upper lid.

5. Apparatus of claim 1 wherein the ambient air inlet ducts have one side which is formed in part by a flat area on a lower lid.

6. Apparatus of claim 1 wherein the inlet ducts and the outlet ducts are approximately horizontal and are in communication with a vertical air flow channel surrounding the fuel canister within the overpack.

7. Apparatus of claim 1 wherein each duct attenuator is of a checkerboard configuration fabricated from between one and two sheetwork members in a first direction and one to two sheetwork members in a second direction perpendicular to the first direction.

8. Apparatus of claim 1 wherein each duct attenuator is fabricated with three or more sheetwork members which are parallel to each other.

9. Apparatus of claim 1 further including a vent screen member at the outside end of each duct to prevent contamination of the ventilation ducts and gridwork.

10. Apparatus of claim 1 wherein the canister is cylindrical in overall shape and the overpack has a cylindrical cavity, the canister having an outside diameter which is smaller than the inside diameter of the overpack cavity, and when the canister is inserted in the cavity of the overpack, a chimney space surrounding the canister is formed, the inlet ducts being in communication with the chimney space to allow cooling air in and the outlet ducts being in communication with the chimney to allow hot air out.

11. Apparatus of claim 1 wherein the dose rate from the ventilation ducts is below 10 mrem/hr.

12. Apparatus according to claim 1 further comprising a spent nuclear fuel canister inserted in a central cavity of the overpack.

13. Apparatus according to claim 1 wherein a radiation scattering attenuator is located at the external opening of each duct.

14. Method of storing spent nuclear fuel comprising inserting spent nuclear fuel in a canister and inserting the canister in a ventilated overpack having inlet ducts and outlet ducts and the ventilation ducts having radiation scattering attenuators, said attenuators fabricated from at least one sheetwork member in a first direction and at least one sheetwork member in a second direction substantially parallel to the first.

15. Method of claim 14 wherein the ducts are straight and heat from the spent nuclear fuel in the canister is removed by the air flowing in through the lower inlet ducts having the radiation scattering attenuators, up a vertical chimney space around the canister, and out the upper outlet ducts having radiation scattering attenuators.

16. Method of claim 15 wherein the dose rate from the ducts is less than about 10 mrem/hr.

* * * * *